United States Patent [19]

Jachowski

[11] Patent Number: 4,596,969

[45] Date of Patent: Jun. 24, 1986

[54] INTERDIGITAL DUPLEXER WITH NOTCH RESONATORS

[75] Inventor: Ronald E. Jachowski, Belmont, Calif.

[73] Assignee: Orion Industries, Inc., Cleveland, Ohio

[21] Appl. No.: 732,357

[22] Filed: May 8, 1985

[51] Int. Cl.[4] ..... H01P 1/213; H01P 5/12; H01P 1/205

[52] U.S. Cl. ..... 333/203; 333/1; 333/127; 333/129

[58] Field of Search ..... 333/202, 203, 204, 205, 333/246, 1, 110, 126, 127, 128, 129; 455/78, 80–82

[56] References Cited

U.S. PATENT DOCUMENTS

| | | | |
|---|---|---|---|
| 3,068,428 | 12/1962 | Alford et al. | 333/234 |
| 3,597,709 | 8/1971 | Rhodes | 333/203 |
| 3,818,389 | 6/1974 | Fisher | 333/203 |
| 4,168,479 | 9/1979 | Rubin | 333/126 |
| 4,210,881 | 7/1980 | Rubin | 333/110 |
| 4,281,302 | 7/1981 | Stegens | 333/204 |
| 4,450,421 | 5/1984 | Meguro et al. | 333/202 |
| 4,488,130 | 12/1984 | Young et al. | 333/203 |

*Primary Examiner*—Marvin L. Nussbaum

*Attorney, Agent, or Firm*—Dressler, Goldsmith, Shore, Sutker & Milnamow, Ltd.

[57] ABSTRACT

A duplexer includes an integral interdigital transmitter filter and parallel interdigital receiver filter in a common housing. A three-quarter wavelength antenna transformer section couples rf energy from the transmitter filter to an antenna and also couples rf energy from the antenna to the receiver filter and to an antenna cable connector. The receiver filter selectivity is improved by providing a notch resonator between a receiver transformer section and the housing, and the transmitter filter selectivity is improved by providing a notch resonator between a transmitter resonator and the housing.

11 Claims, 6 Drawing Figures

INTERDIGITAL DUPLEXER WITH NOTCH RESONATORS

BACKGROUND OF THE INVENTION

The invention relates to duplexers including multiple interdigital filters within a single frame, and more particularly to interdigital filters having internal "notch resonators" that perform a notch filtering function.

Interdigital filters are well-known to those skilled in the art of microwave frequency apparatus, and are described in "Interdigital Band-Pass Filters", by G. L. Matthaei, IRE Transactions on MIT, November, 1962, page 479 and also in the text "Microwave Filter, Impedance-Matching Networks and Coupling Structures", by G. Matthaei, L. Young, and E. M. T. Jones, 1980, published by Artech House, Inc. Interdigital filters include a series of spaced, parallel conductive quarter wavelength resonators in a rectangular conductive housing and arranged in an interdigitated fashion in the sense that opposite ends of adjacent resonators are electrically grounded to the housing. The center frequency of an interdigital band-pass filter is determined by the lengths of its resonators. The interdigital filter bandwidth is determined by the spacing between adjacent resonators, and the width of each resonator determines its impedance. The number of resonators determines the selectivity of the interdigital filter, i.e., the steepness of the "skirt" of its band-pass characteristic. One shortcoming of interdigital filters is that if a high degree of selectivity is required, more resonators of the prescribed width, length, and spacing must be added, increasing the length of the structure. Such an increase in length may, as a practical matter, be unacceptable if the interdigital filter is to be mounted in standard equipment racks along with other microwave modules.

Thus, there is an unmet need for an improved interdigital filter structure and technique for increasing band-pass selectivity without substantially increasing the physical size of the structure. U.S. Pat. No. 4,488,130 describes coupling between resonator sections in a comb-line filter to increase selectivity, but the techniques are not readily applicable to interdigital filters of the type described herein. U.S. Pat. No. 4,281,302 discloses a specialized housing for a microstrip interdigital filter to improve the slope of the low frequency skirt thereof. This technique is not applicable to interdigital filters of the type described herein.

Duplexers are widely used to couple transmitters and receivers to a common antenna. Multiple cavity interdigital filters also are known. U.S. Pat. No. 3,597,709 discloses a structure in which two separate interdigital filters are joined by a common wall having apertures therein to allow coupling of rf energy between the two cavities. U.S. Pat. No. 3,818,389 discloses an interdigital filter structure in which two cavities bounded by the same parallel face plates share a common output resonator. However, the cavities are disposed in end-to-end relationship, with the common resonator being located between them. This structure would not be practical where high selectivity and minimum physical length of the structure is needed. Neither of the foregoing dual cavity interdigital filter structures solve the problems associated with making a minimum size duplexer with interdigital filter structures.

Although duplexers such as the one shown in FIG. 5 have been constructed using interdigital filters, wherein a transmitter 91 and a receiver 96 are coupled to a common antenna 101, it is necessary to very precisely cut the lengths of cables 94 and 99, which couple interdigital filters 93 and 98, respectively, to a T-connector 95 that is connected to the antenna cable 100.

There is an unmet need for a practical interdigital filter duplexer structure that provides maximum isolation between the transmitter and the receiver, yet occupies minimum front panel space in an equipment rack and avoids the need to provide precisely cut lengths of cable to connect the "transmitter" filter and "receiver" filter of a duplexer to the common antenna.

SUMMARY OF THE INVENTION

It is another object of the invention to provide an improved interdigital filter duplexer structure with efficient internal coupling between the multiple filters thereof.

It is another object of the invention to provide a duplexer that does not require cable coupling between its filters.

It is another object of the invention to provide an improved interdigital filter duplexer structure that occupies minimum front panel space.

Briefly described, and in accordance with one embodiment thereof, the invention provides an interdigital filter duplexer which includes a transmitter filter and a receiver filter, each including a plurality of resonators disposed in a single frame with a narrow common conductive wall therebetween and a larger transformer section that couples rf energy from the transmitter filter to a common antenna and also couples rf energy from the antenna to the receiver filter. In this described embodiment of the invention, the transmitter filter and receiver filter are interdigital filters, having quarter wavelength resonators, and the large transformer section is a three-quarter wavelength line having alternate quarter wave sections of its standing waveform aligned with the resonators of the transmitter and receiver filters, respectively. The length of each of the resonators in the first and second filters is one-quarter wavelength. The length of the inter-filter transformer section is three-fourths of a wavelength. Notch resonators are provided in the transmitter and receiver filters between the transformer sections thereof and the adjacent portions of the housing to steepen the adjacent skirt portions of the band-pass characteristics of the transmitter filter and the receiver and thereby increase the isolation between the transmitter and receiver.

DESCRIPTION OF THE INVENTION

Figure 1:
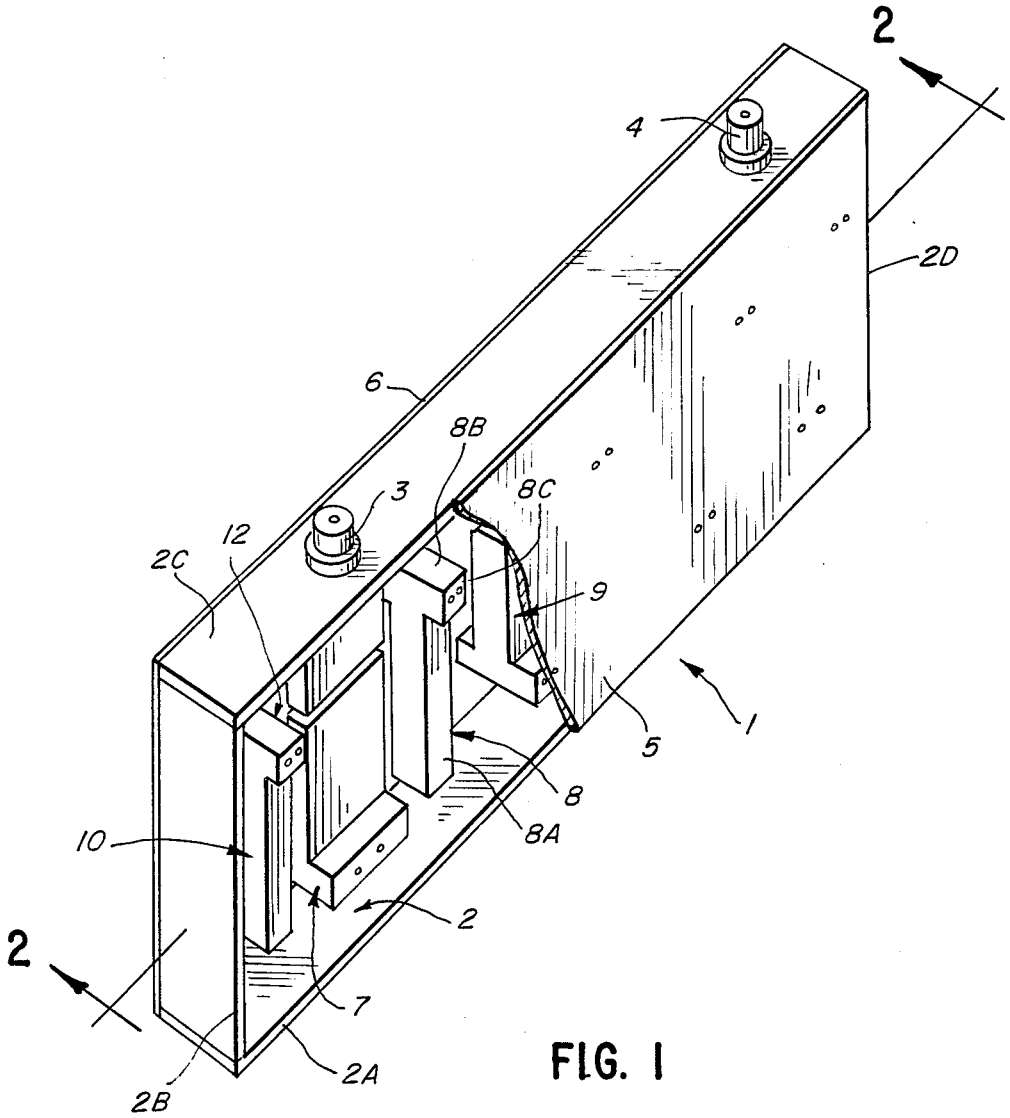
FIG. 1 is a perspective partial cutaway view of an improved interdigital filter of the present invention.
Figure 2:
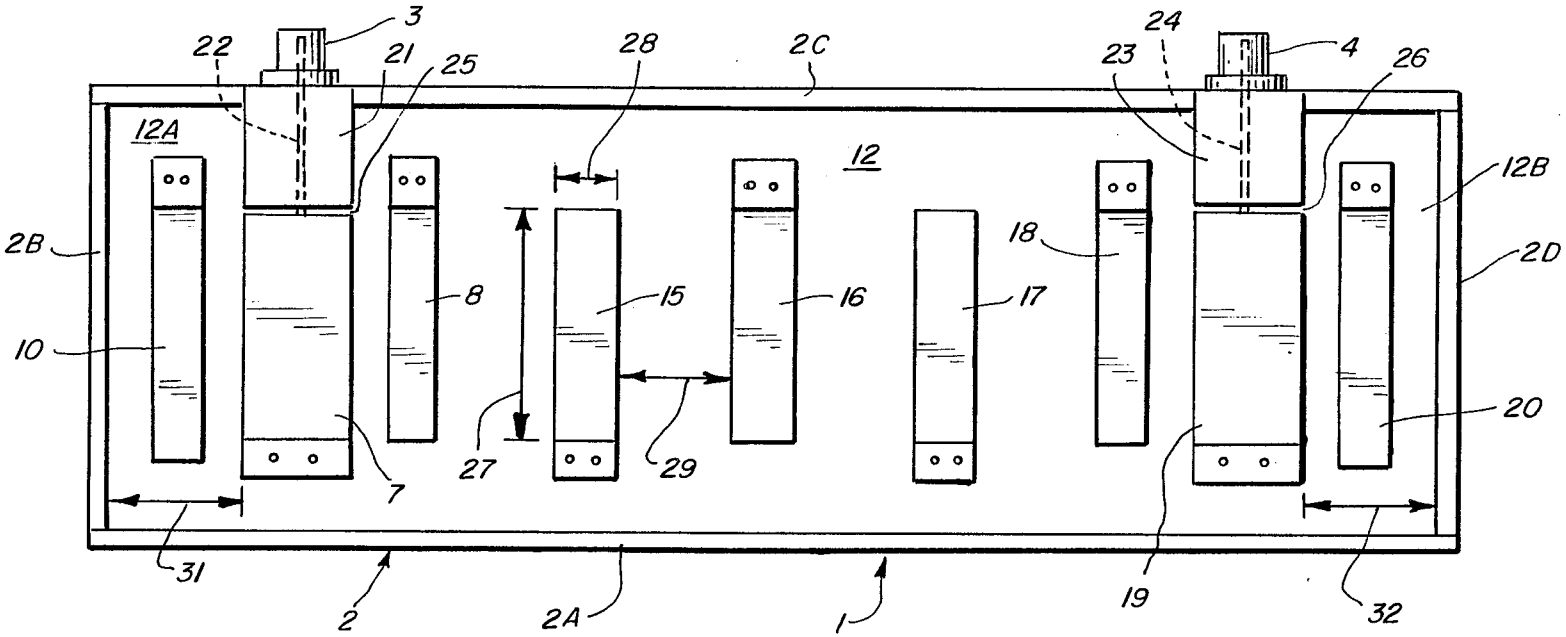
FIG. 2 is a section view taken along section line 2—2 of FIG. 1.

Referring now to FIGS. 1 and 2, interdigital filter 1 includes a rectangular conductive frame 2 including bottom member 2A, top member 2C and end members 2B and 2D defining a thin, elongated rectangular cavity 12. The opposed major faces of interdigital filter 1 are covered by conductive face plates 5 and 6. Interdigital filter 1 includes, within cavity 12, a first group of resonators including 8, 15, 16, 17, and 18, and transformer sections 7 and 19. The latter elements are referred to as "transformer sections" because they "transform" cable conductor to a rectangular line conductor (which then can couple electromagnetic energy to a resonator). In accordance with the present invention, each of the resonators has a T-shaped configuration including a mounting base that is attached by screws to the inner surfaces of the conductive face plates 5 and 6. Each resonator also includes a relatively thin resonator section perpendicular to and centrally supported by the mounting base. For example, in FIG. 1, resonator 8 includes mounting base 8B and thin vertical resonator section 8A. The transformer sections have a similar T-shaped configuration.

As best seen in FIG. 2, transformer section 7 has its free end connected across a narrow gap 25 to a conductor 22 that extends through a conductive block 21 to the center conductor of a coaxial cable connector 3. Similarly, transformer section 19 has its free end connected across a narrow gap 26 to a conductor 24 extending through a rectangular conductive block 23 to the center conductor of a cable connector 4.

The mounting bases of alternate resonators 15 and 17 are attached to lower portions of the conductive faces 5 and 6 of interdigital filter 1. The remaining resonators 8, 16, and 18 have their mounting bases attached to upper portions of the conductive faces 5 and 6. Transformer sections 7 and 9 have their mounting bases attached to lower portions of conductive faces 5 and 6. The band-pass characteristic of interdigital filter 1 can have a shape such as the one indicated by reference numerals 60, 60B in FIG. 4. (The band-pass characteristic 61 will be described subsequently.) The center frequency, designated by line 62 in FIG. 4, of interdigital filter 1 is determined by the length 27 of the resonators 8, 15, 16, 17, and 18. The bandwidth of interdigital filter 1 is determined by the spacing 29 between resonators 8, 15, 16, 17, and 18, the smaller spacing between transformer section 7 and resonator 8, and the smaller spacing between resonator 18 and transformer section 19. (The smaller spacings referred to are required because of the different inpedances of the resonators and the transformer sections.) The width 28 of each resonator determines the impedance of that resonator. An optimum impedance for a resonator is approximately 70 ohms. However, transformer sections 7 and 19 are wider to lower their impedance to 50 ohms in order to accomplish impedance matching to 50 ohm cables (not shown) that are connected to coaxial cable connectors 3 and 4.

As previously mentioned, the selectivity of an interdigital filter, i.e., the extent to which it rejects out-band signals is determined by the number of resonators therein, because the more resonators there are in filter 12, the more out-band energy is attentuated as the signal passes from one end of the interdigital filter to the other.

In accordance with the present invention, the selectivity of interdigital filter 1 is increased by inserting two notch resonators 10 and 20 in the small regions 12A and 12B in FIG. 2, adjacent to the outer sides of transformer sections 7 and 19. The lengths of resonators 10 and 20 are selected to provide a resonant frequency or frequencies that are different than the center frequency designated by line 62 in FIG. 4. For example, if the resonant frequency of both of notch resonators 10 and 20 is selected to have a frequency corresponding to dotted line 65 in FIG. 4, the steepness of the portion of band-pass characteristic 60 designated by dotted line 60B will be increased to produce the steepened skirt portion 60C, greatly increasing the rejection of frequencies greater than the frequency indicated by reference numeral 65.

Figure 4:
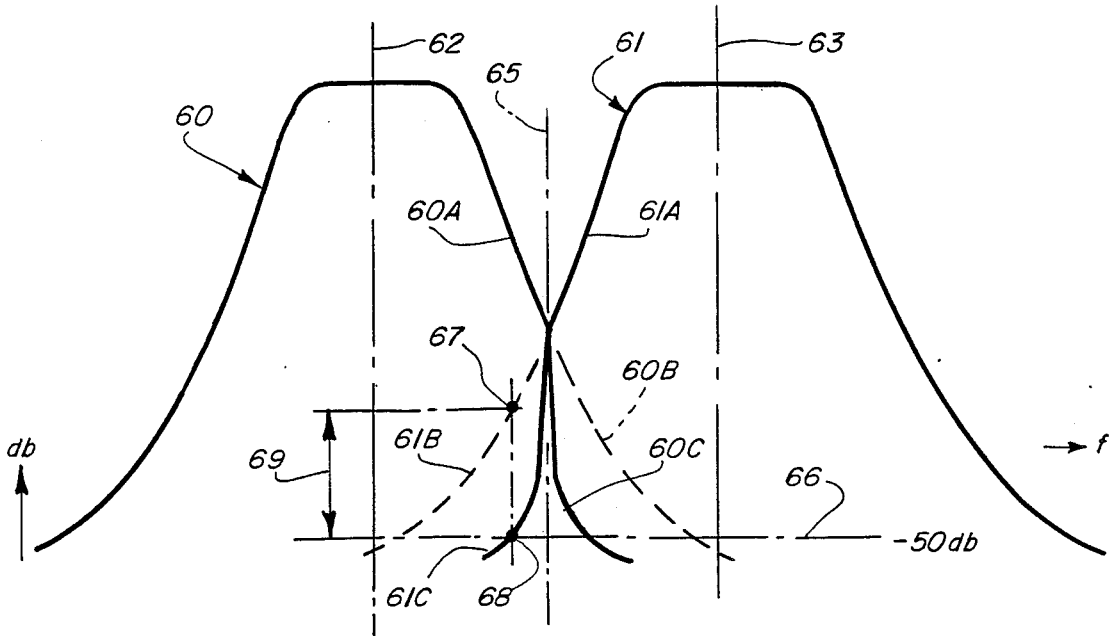
FIG. 4 is a diagram showing the band-pass characteristic of the duplexer of FIG. 3.
Figure 5:
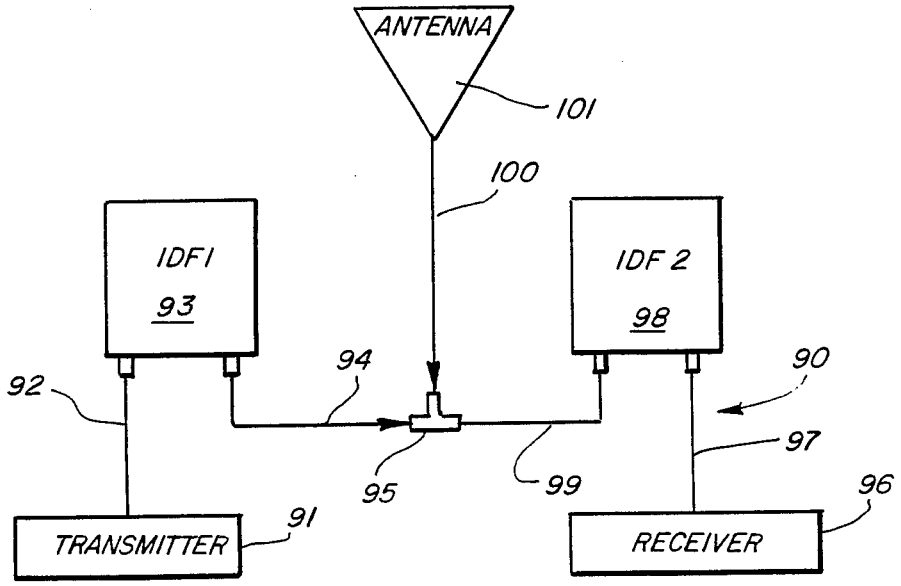
FIG. 5 PRIOR ART
FIG. 5 is a block diagram illustrating the structure of a prior art duplexer.

Depending on how close the frequency 65 is to the frequency designated by reference numeral 62, the "notch" in the band-pass characteristic 60 produced by notch resonators 10 and 20 may be sufficiently narrow that the right-hand portion of the skirt 60 in FIG. 4 might increase before continuing to fall off with further increasing frequency, although this is not shown in FIG. 4.

The above-described structure has the advantage that, for a center frequency of about 800 megahertz, the structure could be made to fit in a standard 19 inch equipment rack, and yet much sharper selectivity could be obtained without increasing the length of the device beyond the 19 inches available.

In accordance with usual practice, frame 2, face plates 5 and 6, and the resonators and the transformer sections, can be composed of copper, coated with silver to provide high surface conductivity. The T-shaped structure of the resonators allows them to be cut from extruded copper sections, significantly decreasing the manufacturing costs of the interdigital filter structure of the present invention.

Figure 3:
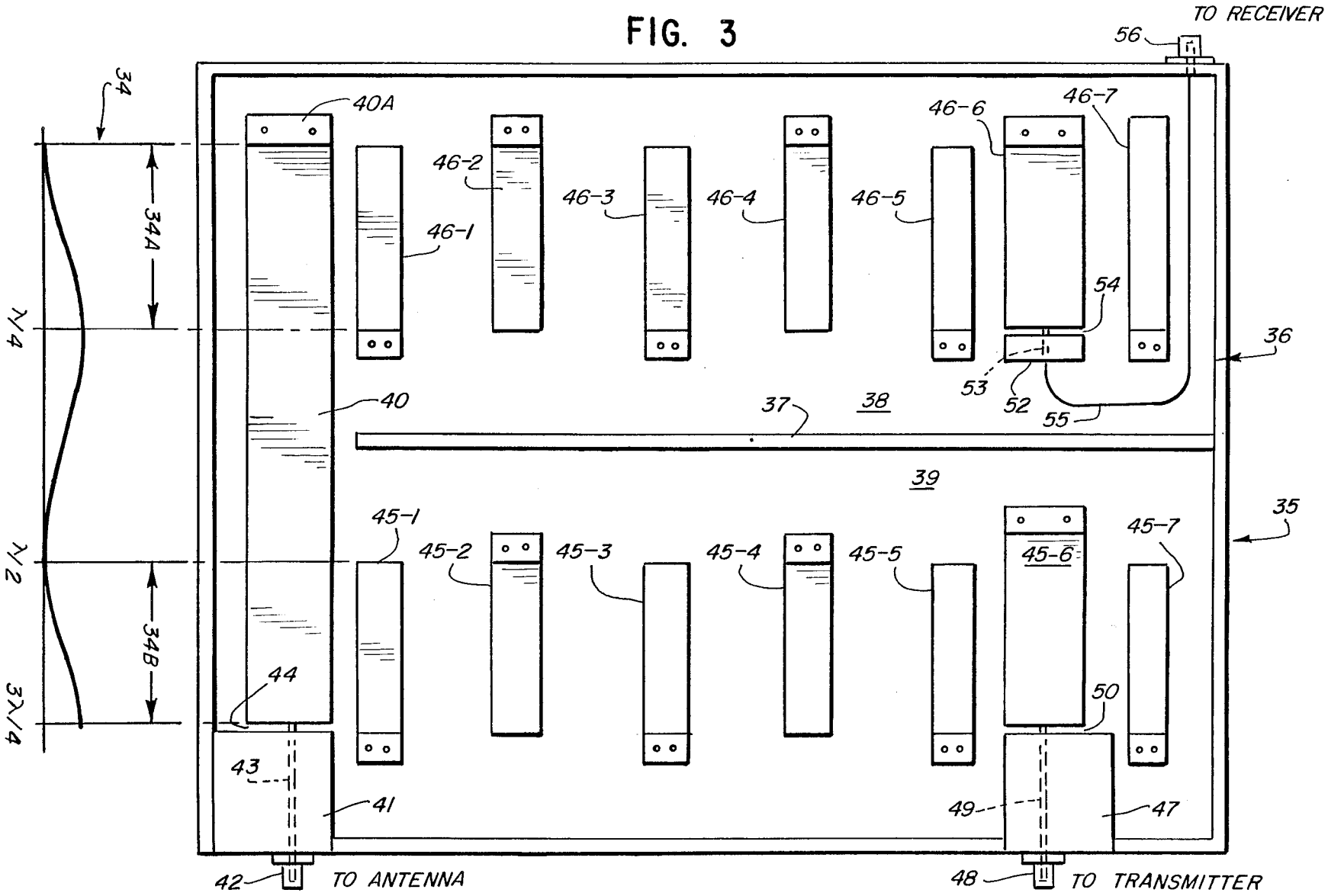
FIG. 3 is a section view of a duplexer of the present invention.

Referring next to FIG. 3, a unitary, dual cavity interdigital filter structure with internal coupling of the filter to an "antenna transformer section" 40 to provide a duplexer 35 is illustrated. Duplexer 35 includes a "receiver filter" 38 including parallel, spaced resonators 46-1 through 46-5 and transformer section 46-6 arranged essentially as described for FIGS. 1 and 2, and each equal in length to one-fourth of the receiver frequency wavelength. Receiver transformer section 46-6 is connected across a gap 54 by a conductor 53 extending through conductive block 52 to a conductor 55. Conductor 55 is routed between resonator 46-7 and frame 36 to a receiver cable connector 56.

Frame 36 includes a narrow conductive member 37 that extends between the opposite conductive faces (such as 5 and 6 in FIG. 1), isolating receiver filter 38 from "transmitter filter" 39. Transmitter filter 39 includes spaced, parallel resonators 45-1 through 45-5 and transformer section 45-6 connected in essentially the manner previously described, and each equal in length to one-quarter of the transmitter frequency wavelength. Transmitter transformer section 45-6 is electrically connected across an impedance matching gap 50 to conductor 49. Conductor 49 extends through conductive block 47 to the center connector conductor of a transmitter cable connector 48.

In accordance with the present invention, a larger "antenna transformer section" 40 has its mounting base 40A attached to the upper portion of the face plate (similar to face plates 5 and 6 in FIG. 1) of duplexer 35 and extends downward past conductive wall 37 and across transmitter filter 3. Transformer section 40 is parallel to and in the same plane as resonators 45-1, etc., and 46-1, etc., and has a length approximately equal to three-quarters of the transmitter or receiver frequency (which is closely spaced). Three-quarter wavelength transformer section 40 is connected across impedance matching gap 44 to the center conductor of antenna cable connector 42.

The correct alignment of three-quarter wavelength antenna transformer section 40 with the quarter wavelength resonators 45-1, etc., and 46-1, etc., is best shown by referring the voltage standing wave waveform 34 of transformer section 40, shown on the left side of FIG. 3. Its rising quarter wave portion 34A is aligned with receiver filter resonators 46-1, etc., and its next rising quarter wave section 34B is aligned with transmitter filter resonators 45-1, etc. This alignment optimizes electromagnetic coupling of rf energy at the receiver frequency and transmitter frequency to the receiver filter and transmitter filter, respectively.

For the purpose of explanation, it will be assumed that interdigital receiver filter 38 has the band-pass characteristic designated by reference numeral 60 in FIG. 4, and that the interdigital transmitter filter 39 has the band-pass characteristic designated by reference numeral 61 in FIG. 4. Thus, the receiver frequency is the frequency designated by dotted line 62, and the transmitter frequency is the frequency designated by dotted line 63.

I have discovered that the above-described structure, is very effective in coupling transmitter signals to the antenna and also in coupling received signals from the same antenna to the receiver connected to cable connector 56, while maintaining excellent isolation between the transmitter and receiver, and very low insertion loss also is achieved.

By placing resonators 46-7 and 45-7 in the position shown in receiver filter 38 and transmitter filter 39, respectively, and causing them each to have a resonant frequency indicated by dotted line 65 in FIG. 4, resonators 46-7 and 45-7 act as "notch resonators" which, in effect greatly steepen the lower portion 60C of the right-hand skirt 60A of the receiver band-pass characteristic 60, and also greatly steepen the lower portion 61C of the left-hand skirt 61A of transmitter band-pass characteristic 61, thereby increasing the isolation between the transmitter and the receiver by approximately 10 to 20 decibels.

In a duplexer which I have constructed in accordance with FIG. 3, the insertion loss measured through either the transmitter filter 39 or the receiver filter 38 is only approximately 0.5 decibels. The attenuation in the reject bands of the receiver filter 38 and the transmitter filter 39 is greater than about 50 decibels. The above duplexer which I have constructed has frequencies selected for use in the mobile communications cellular bands, designed for communication at receiver frequencies in the range from 825 to 851 megahertz and transmitter frequencies in the range from 870 to 896 megahertz. The separation of receiver frequency 62 and transmitter frequency 63 is about 19 megahertz. For this duplexer, the separation of the thin conductive panels (such as 5 and 6 of FIG. 1), and hence the width of the resonator mounting bases, in FIG. 1 is one and one-half inches. The thicknesses of each of the resonators is approximately one-fourth of an inch. The horizontal dimension of the duplexer 35 in FIG. 3 is seventeen and one-half inches, making it easy to attach the device to a front panel suitable for mounting in a typical equipment rack. The vertical frame dimension of the duplexer in FIG. 3 is twelve and one-half inches.

Thus, the duplexer shown in FIG. 3 occupies less than two inches of vertical space in an equipment rack, has very low insertion loss of only about 0.5 decibels, and provides greater than 50 decibels of isolation between the receiver and the transmitter. Furthermore, no precisely cut cables need to be provided between the transmitter cavity and the receiver cavity, nor is any physical space required for such cables. The described duplexer 35 can be manufactured very inexpensively.

Figure 6:
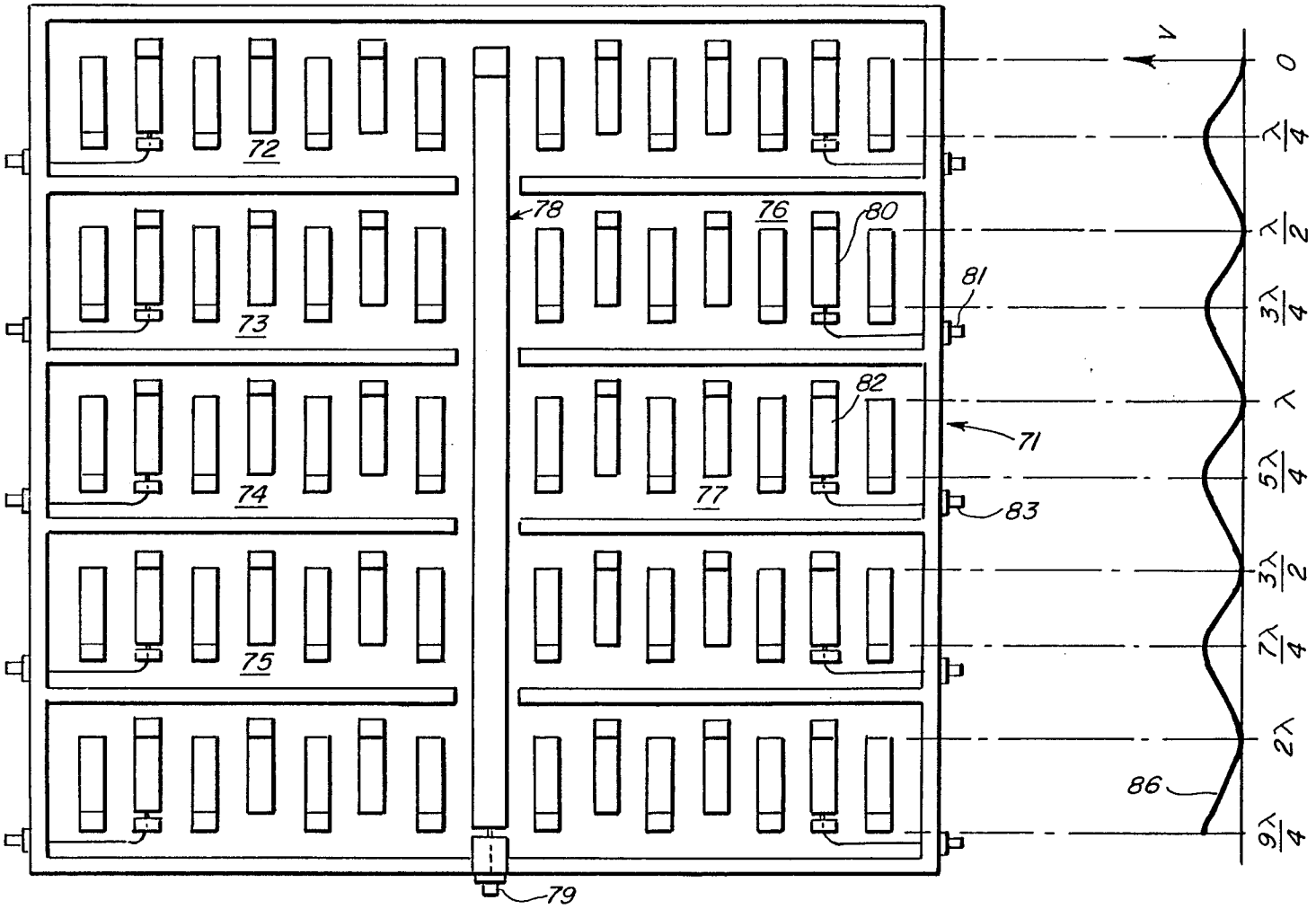
FIG. 6 is a section view of an alternate multiple-filter interdigital filter structure of the present invention.

The basic duplexer structure shown in FIG. 3 can be extended to include more cavities, such as 72, 73, 74, 75, 76, and 77 as shown in FIG. 6. A common or inter-filter transformer section 78, which is an odd multiple number of quarter wavelengths in length, is shared between all of the filters, both to the left and right thereof. Each of the filters includes a typical interdigital filter arrangement of resonators and includes an end transformer section coupled to a cable connector such as 81 or 83. The common inter-filter transformer section 78 is connected at its free end to the center conductor of a coaxial cable connector 79, which can, if desired, be fed to an antenna. Various combinations of receivers and transmitters can be connected to the various cable connectors. As a practical matter, the number of cavities that can be shared with a single inter-filter transformer section such as 78 is limited by frequency spread or separation of the various band-pass filters.

FIG. 6 includes a waveform 86 that represents the standing wave voltage of transformer section 78, and shows how the standing wave sections should be aligned with those of the rows of resonators which are coupled to resonator 78.

While the invention has been described with reference to several particular embodiments thereof, those skilled in the art will be able to make various modifications to the disclosed embodiments of the invention without departing from the true spirit and scope thereof. It is intended that all elements or steps which are equivalent to those of the embodiments of the invention described herein in that they accomplish substantially the same function in substantially the same way to achieve substantially the same result are equivalent to what is described herein. For example, a "transformer section" such as transformer section 40 in FIG. 3 can be used in essentially the same manner in a dual filter comb-line filter structure in which the lengths of the resonators are approximately one-eighth of a wavelength, and the length of the common antenna resonator is three-quarters of a wavelength.

I claim:

1. A multiple filter microwave filtering device comprising:

(a) a first filter, and a first group of spaced parallel resonators in the first filter;

(b) a second filter, and a second group of spaced parallel resonators in the second filter;

(c) a first transformer section at a first end of the first group and first connecting means for electrically connecting the first transformer section to a first cable connector, and a second transformer section at a first end of the second group and second connecting means for electrically connecting the second transformer section to a second cable connector;

(d) a common transformer section extending across a second end of the first filter and a second end of the second filter, the common transformer section having a predetermined first portion aligned with one of the resonators at the second end of the first group and a predetermined second portion spaced from the first portion and aligned with one of the resonators at the second end of the second group to effectuate coupling of rf energy having the resonant frequency of the first filter between the common transformer section and the first filter, and to effectuate coupling of rf energy having the resonant frequency of the second filter between the second filter and the common transformer section, wherein the first and second filters are bounded by a conductive rectangular frame including an elongated conductive divider extending between the first and second filters and nearly to the common transformer section, and thereby separating the first and second filters; and (e) a first notch resonator disposed between the first transformer section and the frame, the first notch resonator having a resonant frequency between the resonant frequencies of the first and second filters; and (f) third connecting means for electrically connecting the common transformer section to a third cable connector.

2. The multiple filter microwave device of claim 1 wherein the first cable connector couples the first filter to a receiver, the second cable connector couples the second filter to a transmitter, and the third cable connector couples both the first and second filters by means of the common transformer resonator to a common antenna.

3. The multiple filter microwave device of claim 2 including a second notch resonator disposed between the second transformer section and the frame, the second notch resonator having a resonant frequency between the resonant frequencies of the first and second filters, the first and second notch resonators having the effect of increasing the isolation between the receiver and the transmitter.

4. The multiple filter microwave device of claim 3 wherein the resonators in each of the first and second filters are arranged to provide first and second interdigital filters, respectively.

5. The multiple filter microwave device of claim 4 wherein the length of each of the resonators in the first group is equal to one-quarter of the wavelength of the resonant frequency of the first filter, the length of each of the resonators in the second group is equal to one-quarter of the wavelength of the resonant frequency of the second filter, and wherein the length of the common transformer section is equal to an odd number of quarter wavelengths of a frequency that is approximately equal to the resonant frequencies of the first and second filters.

6. The multiple filter microwave device of claim 5 wherein a first quarter wavelength section of the common transformer section is aligned with resonators of the first group, and a third quarter wavelength section of the common transformer section is aligned with resonators of the second group, the first group of resonators being spaced approximately one-quarter of a wavelength from the second group of resonators.

7. The multiple filter microwave device of claim 6 including first and second conductive face plates attached to opposite sides of the conductive frame to bound the first and second filters.

8. The multiple filter microwave device of claim 2 wherein each of the resonators of the first and second groups includes a T-shaped structure including a rectangular conductive mounting base and a relatively thin rectangular resonator section integral with the mounting base, each mounting base having opposed faces attached to the inner surface of the first and second face plates to support that resonator.

9. The multiple filter microwave device of claim 8 wherein each of the T-shaped resonators is a piece of extruded copper.

10. A method of operating a duplexer including first and second filters in a single conductive frame and having therein first and second groups of resonators, respectively, the resonators of the first group having a first resonant frequency and the resonators of the second group having a second resonant frequency, the method comprising the steps of:

(a) conducting a transmitter signal having a frequency equal to the first resonant frequency to a first resonator in the first group by means of a first transformer section, the frequency of the transmitter signal being equal to the resonant frequency of the resonators of the first group;

(b) providing a common transformer section for connecting the first and second filters to a common antenna, and aligning a first length of the common transformer section with a second resonator in the first group, and aligning a second length of the common transformer section with a third resonator that is contained in the second group;

(c) coupling the transmitter signal from the second resonator to the common transformer section, and conducting the transmitter signal from the common transformer section to the common antenna;

(d) conducting a received signal having a frequency equal to the second resonant frequency from the common antenna to the common transformer section, and coupling the received signal from the common transformer section to the third resonator, the frequency of the received signal being equal to the resonant frequency of the resonators of the second group and closely spaced from the frequency of the transmitter signal, the length of the common transformer being approximately equal to an odd number of quarter wavelengths of the frequency of the transmitter signal or the received signal;

(e) coupling the received signal from a fourth resonator in the second group to a second transformer section, and conducting the received signal from the second transformer section to a receiver; and (f) shunting electromagnetic energy from one of the first and second transformer sections to the conductive frame by means of a first notch resonator connected to the conductive frame and disposed between that transformer section and the conductive frame, the first notch resonator having a resonant frequency between the first and second resonant frequencies.

11. The method of claim 10 including the step of shunting electromagnetic energy from the other of the first and second transformer sections to the conductive frame by means of a second notch resonator connected to the conductive frame and disposed between the transformer section and the conductive frame, the second notch resonator having a resonant frequency between the first and second resonant frequencies, the first and second notch resonators increasing the isolation between the first and second transformer sections.

* * * * *